US012435530B2

(12) United States Patent
Benton

(10) Patent No.: US 12,435,530 B2
(45) Date of Patent: Oct. 7, 2025

(54) POOL HEATING SYSTEM WITH BAFFLES TO GENERATE HEAT

(71) Applicant: Friction Flow, LLC, St. George, UT (US)

(72) Inventor: Carl Benton, St. George, UT (US)

(73) Assignee: Friction Flow, LLC, St. George, UT (US)

( * ) Notice: Subject to any disclaimer, the term of this patent is extended or adjusted under 35 U.S.C. 154(b) by 353 days.

(21) Appl. No.: 17/816,475

(22) Filed: Aug. 1, 2022

(65) Prior Publication Data

US 2023/0035093 A1 Feb. 2, 2023

Related U.S. Application Data

(60) Provisional application No. 63/244,531, filed on Sep. 15, 2021, provisional application No. 63/227,506, filed on Jul. 30, 2021.

(51) Int. Cl.
*E04H 4/12* (2006.01)

(52) U.S. Cl.
CPC ..... *E04H 4/129* (2013.01)

(58) Field of Classification Search
CPC ..... E04H 4/12
See application file for complete search history.

(56) References Cited

U.S. PATENT DOCUMENTS

| | | | | |
|---|---|---|---|---|
| 2,677,394 | A | 5/1954 | Brinen et al. | |
| 2,688,986 | A * | 9/1954 | O'Brien | F28F 13/12 138/42 |
| 3,734,065 | A | 5/1973 | Reid, Jr. et al. | |
| 2010/0170452 | A1 * | 7/2010 | Ford | F24H 9/0036 122/18.1 |
| 2012/0151950 | A1 | 6/2012 | Jagusztyn | |
| 2016/0348981 | A1 * | 12/2016 | Rodrick | E04H 4/14 |
| 2020/0032536 | A1 * | 1/2020 | Corn | F24H 1/145 |

FOREIGN PATENT DOCUMENTS

| | | | | |
|---|---|---|---|---|
| WO | WO2023010136 | * | 2/2023 | E04H 4/129 |

* cited by examiner

*Primary Examiner* — Lauren A Crane
(74) *Attorney, Agent, or Firm* — Gurr & Brande, PLLC; Robert A. Gurr

(57) ABSTRACT

A pool heating system has a housing, a water inlet, a plurality of pipes comprising baffles, and a water outlet. The baffles create turbulence in the flow of the water, increasing kinetic energy and pressure (compression). As a result of the compression and kinetic energy, the temperature of the water increases. The water then passes to the outlet, where it exits at a higher temperature than when it entered.

1 Claim, 10 Drawing Sheets

POOL HEATING SYSTEM WITH BAFFLES TO GENERATE HEAT

CROSS-REFERENCE TO RELATED APPLICATIONS

This application claims the benefit of U.S. Provisional Application Ser. No. 63/227,506 filed Jul. 30, 2021 and further claims priority to Provisional Application Ser. No. 63/244,531, filed on Sep. 15, 2021, which are both incorporated herein by reference.

TECHNICAL FIELD

The present disclosure relates to pool heaters. More particularly, the present disclosure relates to a pool heater that utilizes baffles to generate heated water.

BACKGROUND

Pool heaters in the market are inefficient and/or expensive to use. For example, natural gas and propane heaters are capable of heating water regardless of ambient temperature, but are not very efficient—a lot of heat is lost, carbon monoxide is produced, and the flames weaken the metal and reduce the lifespan of the equipment. On the other hand, electric heat pumps take longer to heat the water and are dependent on the ambient temperature, which results in electric heat pumps being generally ineffective under ambient temperatures of 60 degrees Fahrenheit.

Accordingly, there is a need for a system and method of heating water that does not rely on flames or ambient air temperature. The present disclosure seeks to solve these and other problems.

SUMMARY OF EXAMPLE EMBODIMENTS

In one embodiment, a pool heating system comprises a housing, a water inlet, a plurality of pipes comprising baffles, and a water outlet. The baffles create turbulence in the flow of the water, increasing kinetic energy and pressure (compression). As a result of the compression and kinetic energy, the temperature of the water increases. The water then passes to the outlet, where it exits at a higher temperature than when it entered.

DETAILED DESCRIPTION OF EXAMPLE EMBODIMENTS

Figure 1:
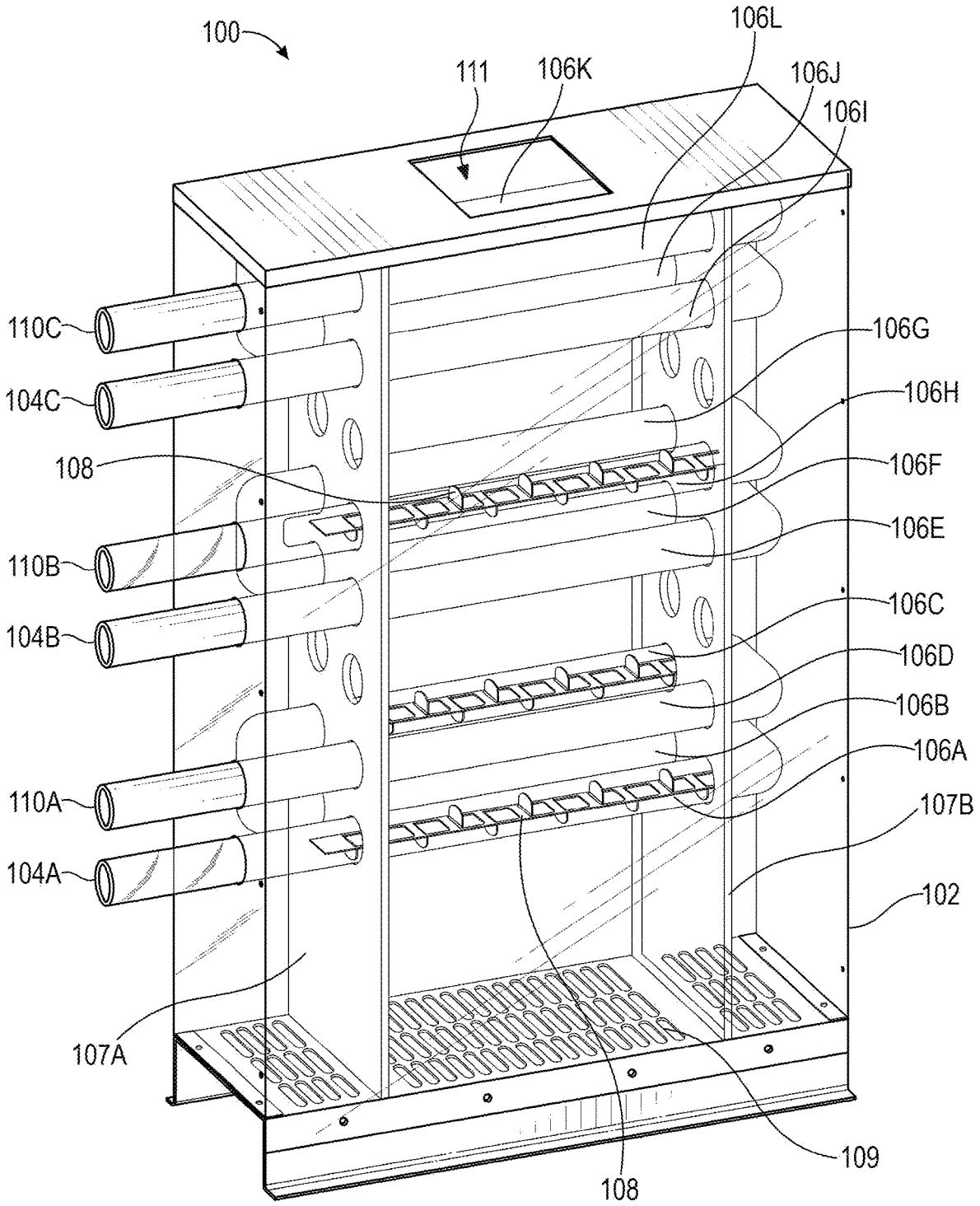
FIG. 1 is a front perspective view of a pool heating system.

The following descriptions depict only example embodiments and are not to be considered limiting in scope. Any reference herein to "the invention" is not intended to restrict or limit the invention to exact features or steps of any one or more of the exemplary embodiments disclosed in the present specification. References to "one embodiment," "an embodiment," "various embodiments," and the like, may indicate that the embodiment(s) so described may include a particular feature, structure, or characteristic, but not every embodiment necessarily includes the particular feature, structure, or characteristic. Further, repeated use of the phrase "in one embodiment," or "in an embodiment," do not necessarily refer to the same embodiment, although they may.

Reference to the drawings is done throughout the disclosure using various numbers. The numbers used are for the convenience of the drafter only and the absence of numbers in an apparent sequence should not be considered limiting and does not imply that additional parts of that particular embodiment exist. Numbering patterns from one embodiment to the other need not imply that each embodiment has similar parts, although it may.

Accordingly, the particular arrangements disclosed are meant to be illustrative only and not limiting as to the scope of the invention, which is to be given the full breadth of the appended claims and any and all equivalents thereof. Although specific terms are employed herein, they are used in a generic and descriptive sense only and not for purposes of limitation. Unless otherwise expressly defined herein, such terms are intended to be given their broad, ordinary, and customary meaning not inconsistent with that applicable in the relevant industry and without restriction to any specific embodiment hereinafter described. As used herein, the article "a" is intended to include one or more items. When used herein to join a list of items, the term "or" denotes at least one of the items, but does not exclude a plurality of items of the list. For exemplary methods or processes, the sequence and/or arrangement of steps described herein are illustrative and not restrictive.

It should be understood that the steps of any such processes or methods are not limited to being carried out in any particular sequence, arrangement, or with any particular graphics or interface. Indeed, the steps of the disclosed processes or methods generally may be carried out in various sequences and arrangements while still falling within the scope of the present invention.

The term "coupled" may mean that two or more elements are in direct physical contact. However, "coupled" may also mean that two or more elements are not in direct contact with each other, but yet still cooperate or interact with each other.

The terms "comprising," "including," "having," and the like, as used with respect to embodiments, are synonymous, and are generally intended as "open" terms (e.g., the term "including" should be interpreted as "including, but not limited to," the term "having" should be interpreted as "having at least," the term "includes" should be interpreted as "includes, but is not limited to," etc.).

As previously discussed, there is a need for a system and method of heating water that does not rely on flames or ambient air temperature. The pool heating system disclosed herein seeks to solve these and other problems.

Figure 2:
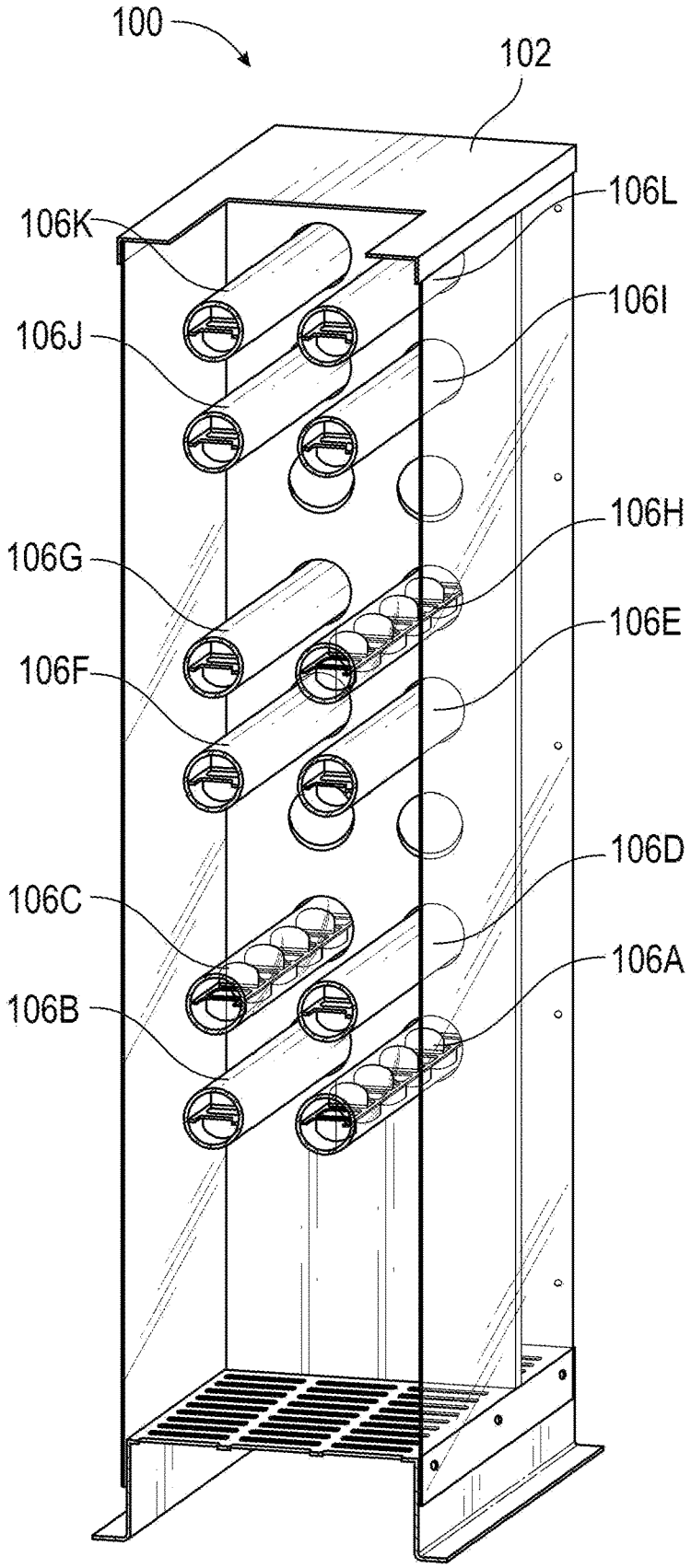
FIG. 2 is a side, cross-section of a pool heating system.

In one embodiment, as shown in FIGS. 1-2, a pool heating system 100 comprises a housing 102 (shown transparent in the drawings for ease of understanding internal components), at least one water inlet 104A-C, a plurality of pipes 106A-L each comprising baffles 108 (several baffles 108 visible as a result of pipes 106A, 106C and 106H illustrated as transparent), and at least one water outlet 110A-C. The baffles 108 (best shown in FIGS. 3-5) create turbulence in the flow of the water, increasing kinetic energy and pressure (compression). As a result of the compression and kinetic energy, the temperature of the water increases. The water then passes to the outlet 110A-110C, where it exits at a higher temperature than when it entered. For example, water enters a first side at an inlet 104A, passes through pipe 106A having a baffle 108, then through pipe 106B having a baffle 108, through pipe 106C having a baffle 108, through pipe 106D having a baffle 108, and finally to the outlet 110A. Due to the baffles 108 in each pipe 106A-D, the water is compressed, generating heat. The housing may comprise a frame or stabilization board 107A-B for stabilizing the pipes 106A-L. Additionally, it will be appreciated that the inlets 104A-C may be coupled together via a manifold or header and that, likewise, the outlets 110A-C may also be coupled to one another via a manifold or header.

Figure 3:
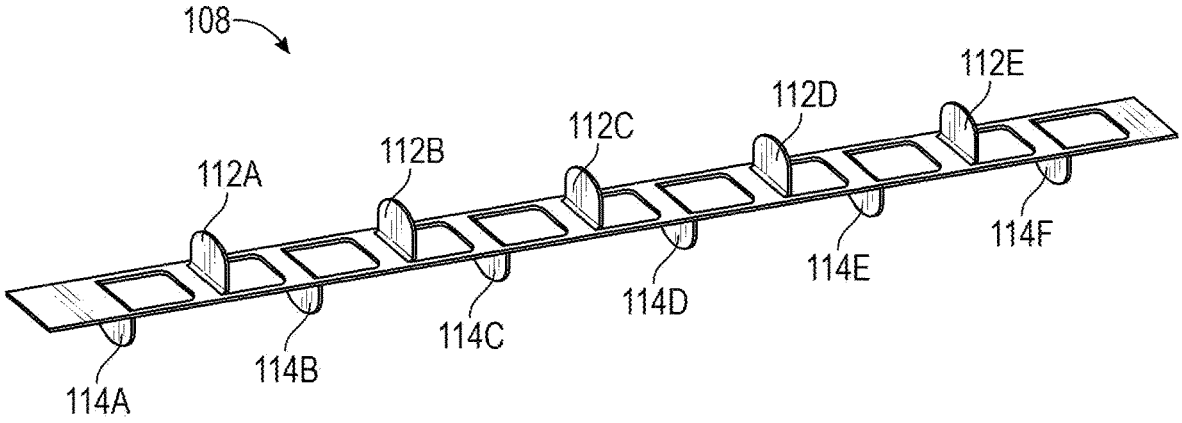
FIG. 3 is a right side perspective view of a baffle of a pool heating system.
Figure 4:
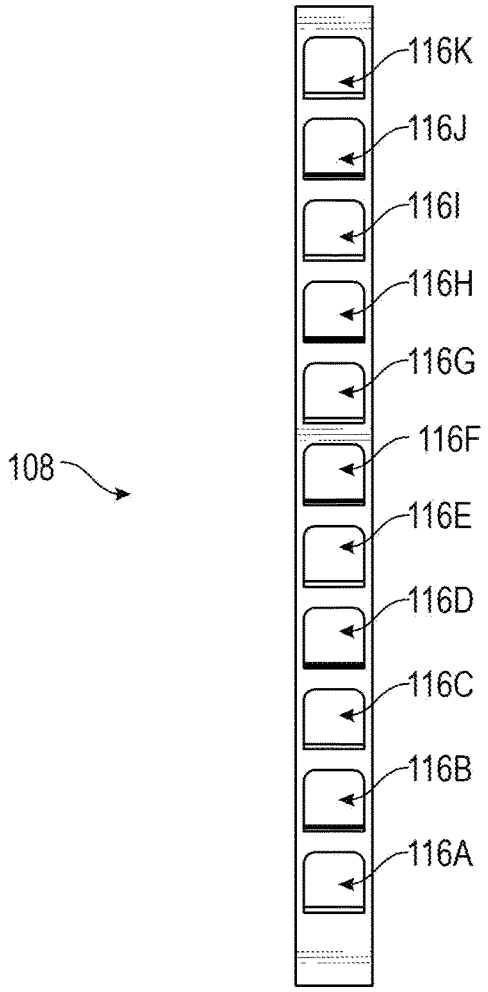
FIG. 4 is a top plan view of a baffle of a pool heating system.
Figure 5:
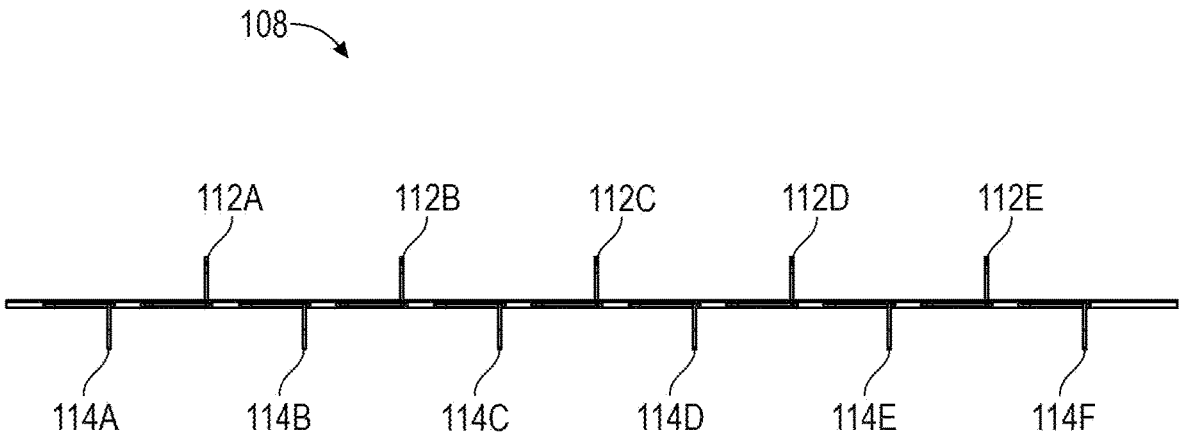
FIG. 5 is a right side elevation view of a baffle of a pool heating system, the left side being a mirror image.

The baffles 108 may take a variety of shapes and sizes, but one example of a baffle 108 is illustrated in FIGS. 3-5. As appreciated, the baffle 108 is sized so as to be just smaller (i.e., width) than the inner diameter of a pipe 106A-L, with the length running at least the majority of the length of the pipe 106A-L. Each baffle 108 comprises a plurality of upward tabs 112A-E and downward tabs 114A-F. It will be appreciated that the upward tabs 112A-E and downward tabs 114A-F are not limited to a particular number or configuration. Nonetheless, each tab 112A-E, 114A-F is ideally arcuate on its distal end so as to conform to the inner diameter of a pipe 106A-L, thus restricting the flow of water in the pipe 106A-L. Referring to FIG. 4, apertures 116A-K are formed as a result of the tabs 112A-E, 114A-E. For example, the baffle 108 may be manufactured by starting with a piece of sheet metal and then cutting and bending tabs 112A-E, 114A-F accordingly. Again, the number of apertures 116A-K and the tabs 112A-E, 114A-F may vary without departing herefrom.

Figure 6:
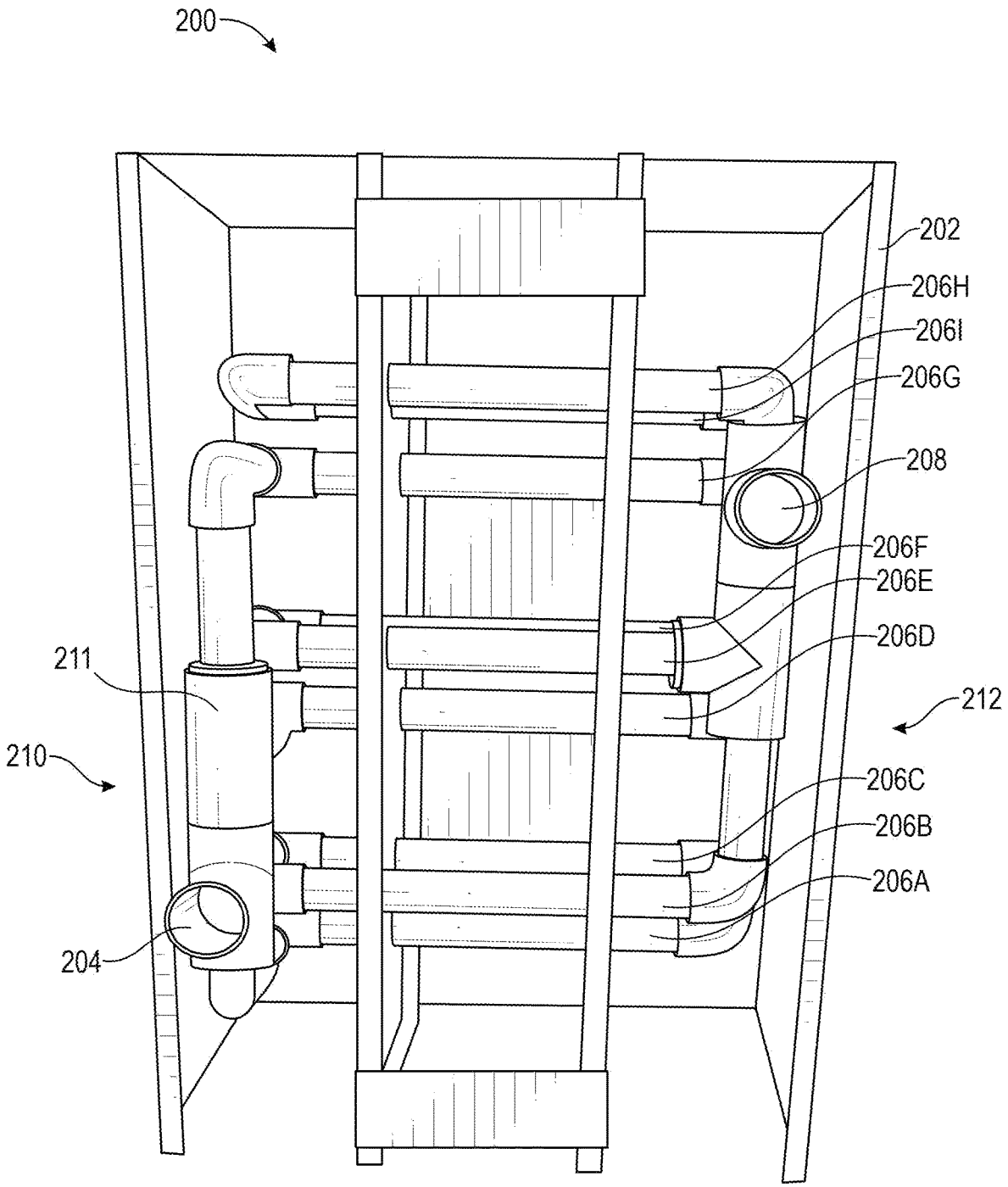
FIG. 6 is a front perspective view of a pool heating system.
Figure 7:
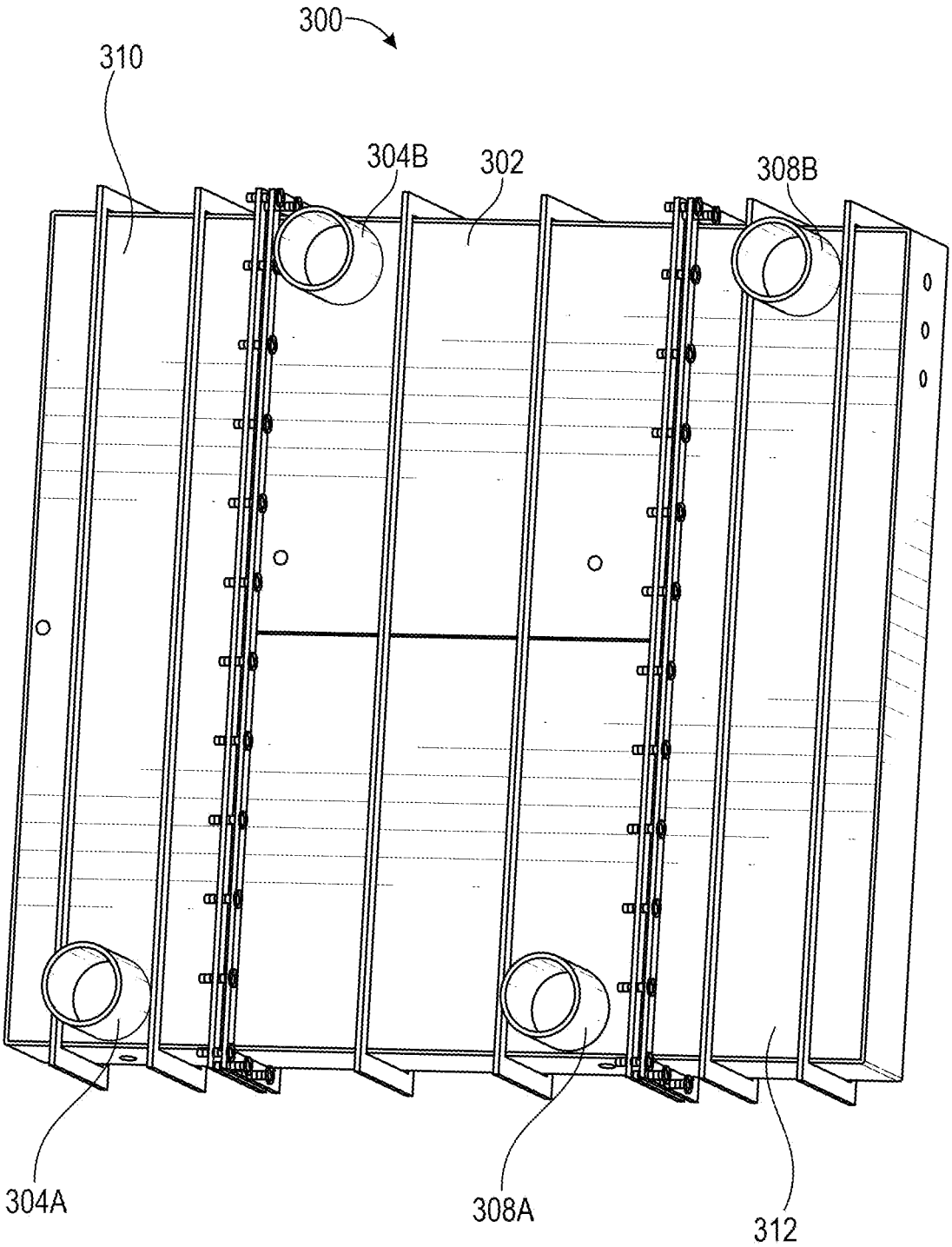
FIG. 7 is a front perspective view of a pool heating system.
Figure 8:
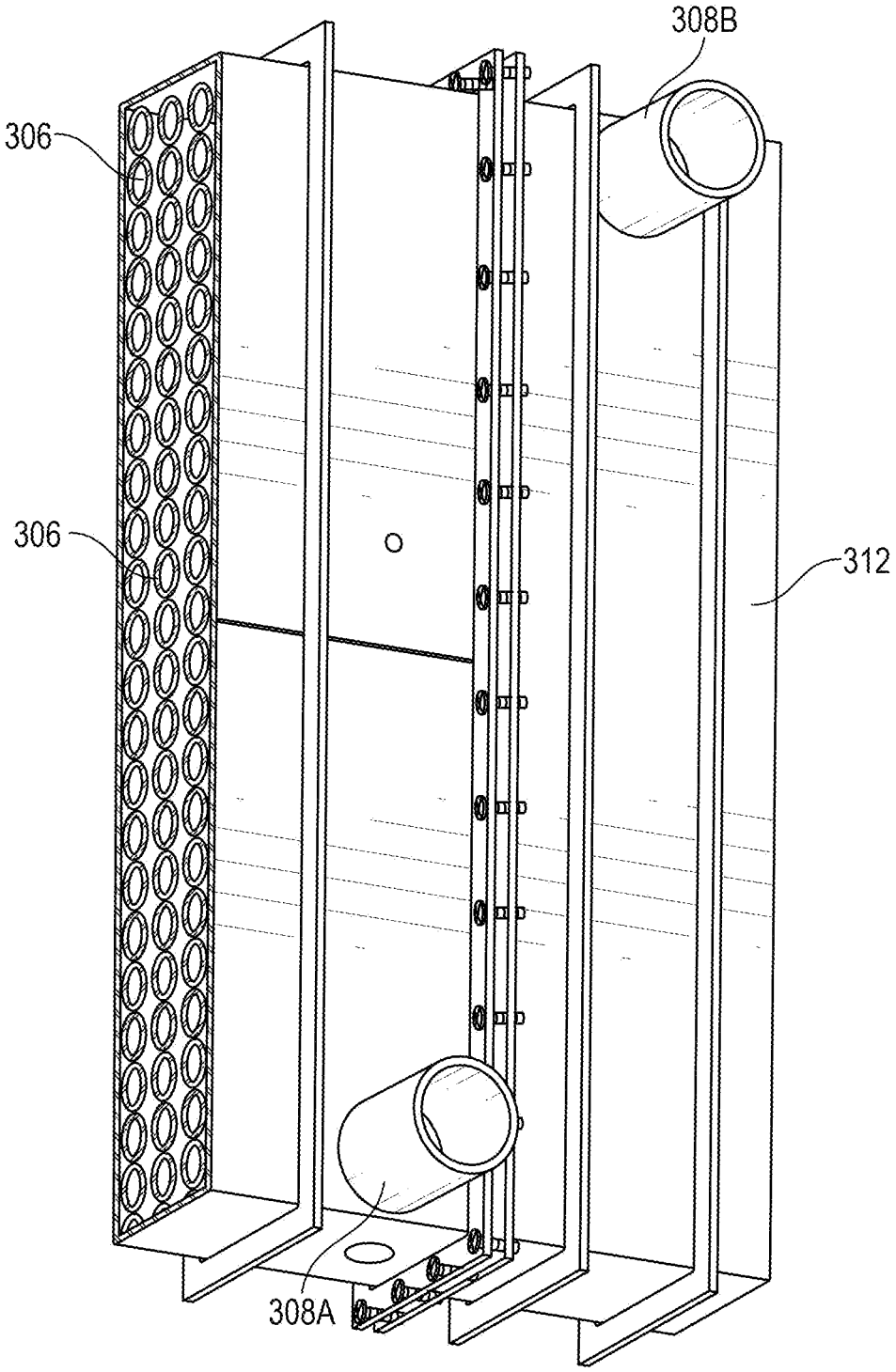
FIG. 8 is a vertical cross-section of a pool heating system.
Figure 9:
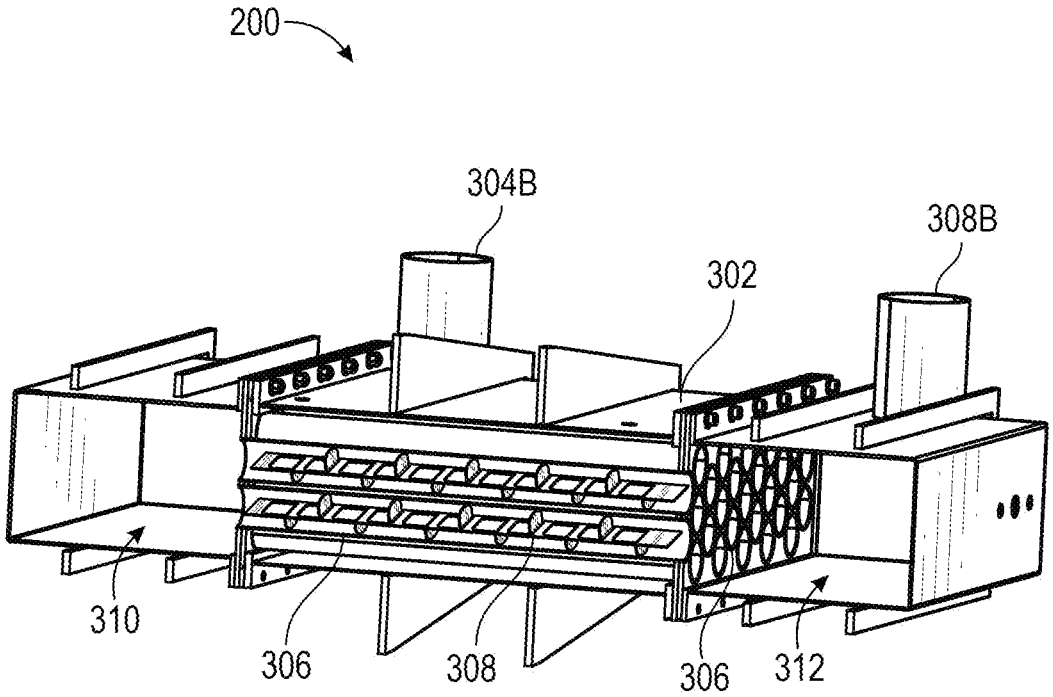
FIG. 9 is a horizontal cross-section of a pool heating system.
Figure 10:
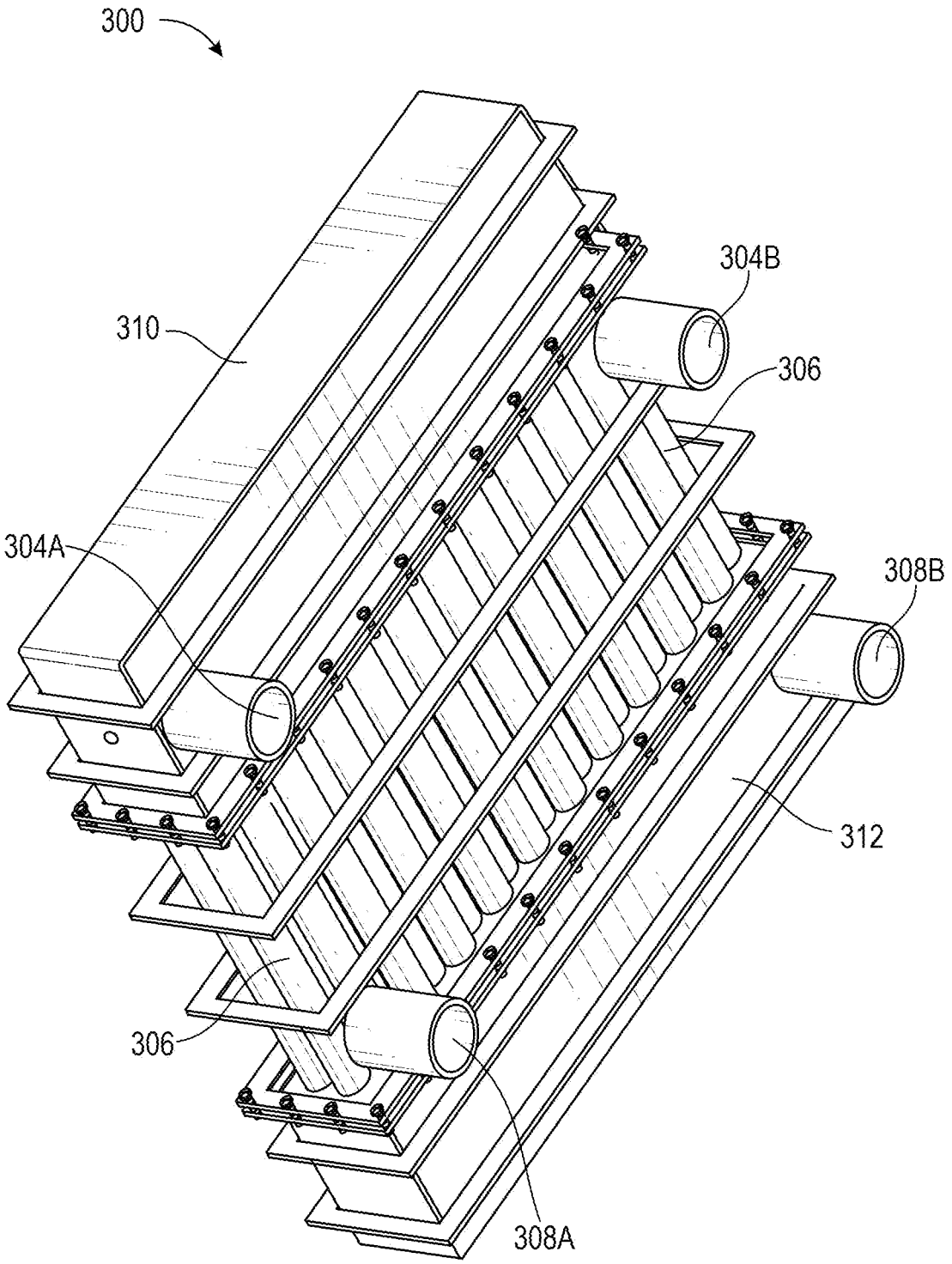
FIG. 10 is a front perspective view of a pool heating system.

In one embodiment, as shown in FIG. 6, a pool heating system 200 comprises a heater housing 202, an inlet 204, a plurality of pipes 206A-I, each having a baffle 108 (FIGS. 3-5) therein (not visible in this view), and an outlet 208. For example, water enters the inlet 204 and is distributed amongst the horizontal pipes 206A-I as it flows from an inlet side 210 to the outlet side 212, generally simultaneously due to pressure equalization. The pipes 206A-I may be coupled to the inlet 210 via a manifold 211. The flow of water is then restricted in the pipes 206A-I due to the baffles 108 therein, with the water being forced through each aperture 116A-K, respectively, increasing kinetic energy and thereby compressing the water, causing it to heat. Because the baffle 108 in each pipe 206A-I causes compression of the water, the water then exits the outlet 208 at a higher temperature than when it entered. Accordingly, no flame is applied to the pipes 206A-I, nor is the system dependent on ambient temperatures, thereby overcoming the problems in the art. Additionally, the electricity needed to pump the water through pipes 206A-I and their baffles 108 costs significantly less than natural gas or propane. Accordingly, the pool heating systems 100, 200 solve the problems in the art by generating heated water at low cost, without flames, and without being dependent upon ambient air temperature.

In one embodiment, as shown in FIGS. 7-10, a pool heating system 300 comprises a housing 302, at least one inlet 304A-B, a plurality of pipes 306 comprising baffles 108 (best seen in FIG. 9), and at least one outlet 308A-B. The water may enter inlet 304A into inlet chamber 310, where the water then beings to flow through the plurality of pipes 306 with baffles 108 therein. In this embodiment, the pipes 306 are not coupled to one another, but run parallel to each other with pressure forcing the water from the inlet chamber 310, through the plurality of pipes 306, and into an outlet chamber 312, where it may exit outlet 308B. Because the water is forced through the plurality of pipes 306, each comprising a baffle 108, kinetic energy is increased and the water is compressed, which causes it to increase in temperature. As a result, water exiting the outlet 310A-B is hotter than water that entered the inlet 304A-B.

Figure 11:
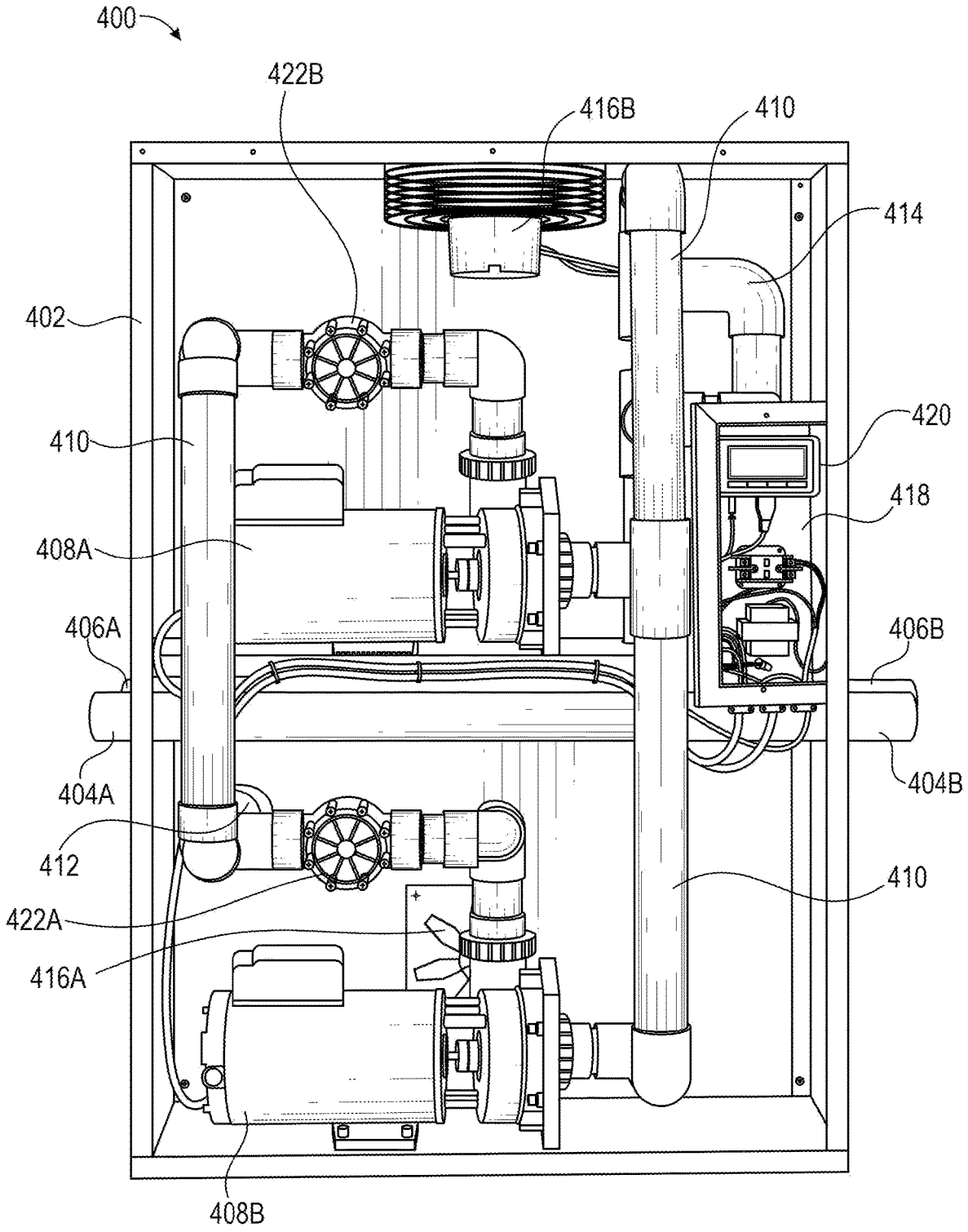
FIG. 11 is a rear elevation view of a pump system of a pool heating system.

In some embodiments, the pool heating system 100, 200, 300 comprises a pump system 400. Referring to FIG. 11, the pump system 400 comprises a housing 402, which may be a separate housing or may be coupled to, or integrated with, housings 102, 202, 302 disclosed herein. The pump system 400 may have a first pool inlet 404A on a first side and a second pool inlet 404B on a second side, and a first pool outlet 406A on a first side and a second pool outlet 406B on a second side. This allows a user to couple pool pipes on either side of the pump system 400, allowing for easier installation and less piping. For example, if a user has pool piping (e.g., from the pool, from a pool filter, from a pump, etc.) on the first side of the pump system 400, a user may couple the pool pipe to the first inlet 404A and the first outlet 406A (returning to the pool). The user would then cap the second inlet 404B and second outlet 406B. However, while multiple inlets and outlets are shown, it will be appreciated that only one of each is required.

The water from the inlet 404A is then drawn into the pool heating system 100, 200, 300 via at least one pump 408A, 408B. While two pumps 408A-B are shown, it will be appreciated that more or fewer may be used so long as there is sufficient pressure to force the water through the baffles 108. However, it will be understood that the higher the flow rate, the faster the water heats. The water is pumped through a plurality of pipes 410 that couple the one or more pumps 408A-B to pump system outlet 412. Pump system outlet 412 is coupled to an inlet of a pool heating system 100, 200, 300, such as inlet 204 in FIG. 6. The water then passes through the baffles 108 in pipes 206A-I, through outlet 208 and, referring back to FIG. 11, is coupled to heater inlet 414 where the water then proceeds to return to the pool via outlet 406A.

In some embodiments, one or more fans 416A-B aid in removing excess heat produced from the pumps 408A-B from the housing 402. In some embodiments, air flows from a first, lower fan 416A to a second, higher fan 416B, where it is then directed into the housing 102, 202, 302, aiding to heat the water as it passes through the baffles 108. It will be appreciated that the housing 102, 202, 302 may likewise comprise a fan or vent (such as vent 109 in FIG. 1-2) to allow the flow of air to pass through, preferably near the bottom of the housing 102, 202, 302. For example, the heated air may pass through a duct from housing 402 to housing 102, 202, 302, such as through opening 111 (FIG. 1), where cooler air is forced down through vent 109, thereby increasing the internal temperature of housing 102.

In some embodiments, the pumps 408A-B and the fans 416A-B may be electrically controlled via an electrical panel 418 comprising a controller 420. For example, one or more thermostats may be used to determine the temperature of the water as well as the temperature within the housing 402. Based upon preprogrammed logic, the controller 420 (e.g., microcontroller) turns on/off the pumps 408A-B and fans 416A-B. For example, if the water temperature is below a predetermined threshold, the controller 420 turns on the pumps 408A-B, forcing the water through the baffles 108 of the pipes (e.g., 206A-I) to heat the water. When the temperature inside the housing 402 reaches a predetermined threshold, the controller 420 may turn on the fans 416A-B to remove the excess heat and, in some embodiments, direct that heated air into the housing 102, 202, 302 to aid in further heating the water as it passes through baffles 108.

The controller 420 may comprise a user display, as well as allow for user input (e.g., setting temperatures) through a user interface (e.g., touchscreen, buttons, wireless connection with smartphone, etc.). The inlets, outlets, and pipe orientation and configuration may vary without departing herefrom. It will be appreciated that when the pumps 408A-B are off and water is not flowing through the pool heating system 100, 200, 300, one or more check valves 422A-B prevent the backflow of water. It will be appreciated that a pool pump may be located outside of the housing 402 and coupled to an inlet 404A-B. For example, water will flow through the inlet 404A and out of the outlet 406A without passing through pipes 206A-I when pumps 408A-B are not on. However, when the pumps 408A-B are on, such as in response to the controller determining that the water temperature is below a predetermined threshold, the pumps 408A-B then redirect the water through the pipes 206A-I with baffles therein before the water is returned to exit outlet 406A. In other words, water flows regardless of whether it is being heated. In some embodiments, the first pump 408A may be used for water circulation while the second pump 408B is used to pass the water to pipes 206A-I for heating. It will be appreciated that numerous pump and pipe configurations may be used without departing herefrom.

Accordingly, the pool heating system disclosed herein solves the need for a system and method of heating water that does not rely on flames or ambient air temperature, overcoming the prior art.

It will be appreciated that systems and methods according to certain embodiments of the present disclosure may include, incorporate, or otherwise comprise properties or features (e.g., components, members, elements, parts, and/or portions) described in other embodiments. Accordingly, the various features of certain embodiments can be compatible with, combined with, included in, and/or incorporated into other embodiments of the present disclosure. Thus, disclosure of certain features relative to a specific embodiment of the present disclosure should not be construed as limiting application or inclusion of said features to the specific embodiment unless so stated. Rather, it will be appreciated that other embodiments can also include said features, members, elements, parts, and/or portions without necessarily departing from the scope of the present disclosure.

Moreover, unless a feature is described as requiring another feature in combination therewith, any feature herein may be combined with any other feature of a same or different embodiment disclosed herein. Furthermore, various well-known aspects of illustrative systems, methods, apparatus, and the like are not described herein in particular detail in order to avoid obscuring aspects of the example embodiments. Such aspects are, however, also contemplated herein.

Exemplary embodiments are described above. No element, act, or instruction used in this description should be construed as important, necessary, critical, or essential unless explicitly described as such. Although only a few of the exemplary embodiments have been described in detail herein, those skilled in the art will readily appreciate that many modifications are possible in these exemplary embodiments without materially departing from the novel teachings and advantages herein. Accordingly, all such modifications are intended to be included within the scope of this invention.

What is claimed is:

1. A pool heating system, comprising:

a pump housing, comprising:
- a pool inlet,
- a pool outlet,
- at least one pump configured to draw water from a pool through the pool inlet,
- a pump system outlet,
- a heater inlet, and
- at least one fan;

a heater housing, comprising:
- a water inlet,
- a plurality of pipes coupled to the water inlet, each pipe comprising a baffle, each baffle comprising:
  - a plurality of upward tabs,
  - a plurality of downward tabs, and
  - a plurality of apertures, wherein each of the plurality of upward tabs is separated from each of the plurality of downward tabs by a respective aperture of the plurality of apertures,
  - wherein the plurality of upward tabs and the plurality of downward tabs each comprise an arcuate distal end;
- a water outlet coupled to the plurality of pipes;

wherein the water inlet of the heater housing is coupled to the pump system outlet, and the heater inlet of the pump housing is coupled to the water outlet of the heater housing, wherein water is configured to flow from the pool into the pool inlet via the at least one pump, the water exiting the pump housing via the pump system outlet and flowing into the heater housing via the water inlet, the water passing through the plurality of pipes comprising baffles therein to increase a temperature of the water, the water exiting the heater housing via the water outlet and entering the pump housing via the heater inlet, the water then exiting the pump housing and back to the pool via the pool outlet.

* * * * *